United States Patent [19]

Meschi

[11] Patent Number: 4,997,119

[45] Date of Patent: Mar. 5, 1991

[54] TEARING DEVICE FOR BANDS OF SHEET MATERIALS, SUCH AS PAPER BANDS

[75] Inventor: Luciano Meschi, Leghorn, Italy

[73] Assignee: Industria Gafica Meschi S.r.l., Leghorn, Italy

[21] Appl. No.: 440,515

[22] Filed: Nov. 21, 1989

[30] Foreign Application Priority Data

Nov. 21, 1988 [IT] Italy ..... 22177/88[U]

[51] Int. Cl.[5] ..... B26F 3/02

[52] U.S. Cl. ..... 225/100; 225/106

[58] Field of Search ..... 225/100, 5, 106

[56] References Cited

U.S. PATENT DOCUMENTS

| | | | |
|---|---|---|---|
| 2,717,642 | 9/1955 | Pealler | 225/100 |
| 3,741,451 | 6/1973 | Parenti et al. | 225/100 |
| 4,025,023 | 5/1977 | Moffit | 225/100 |
| 4,284,221 | 8/1981 | Nagel et al. | 225/100 |
| 4,375,189 | 3/1983 | Berner et al. | 225/100 |
| 4,397,410 | 8/1983 | Schueler | 225/100 |
| 4,577,789 | 3/1986 | Hofmann et al. | 225/100 |

*Primary Examiner*—Hien H. Phan

*Attorney, Agent, or Firm*—McAulay Fisher Nissen & Goldberg

[57] ABSTRACT

Tearing device for the tearing off of a band (26) in a desired point provided with a zone (90) arranged to make the tearing easier, such as a weakening by means of perforations or slits provided along a predetermined line, comprising at least a first pair of opposed and perfectly cylindrical rollers (30,32) driven at a first rotation rate, and at least a second pair of opposed rollers (50,52), each having at least a planar bevel (54,56), the second roller pair being positioned downstream with respect to the first pair and being normally stationary with the bevels facing each other, the rollers (54,56) of the second pair being driven, upon receiving a command signal coming from a detector (74) at a rotation rate definitely higher than that of the first pair of rollers, thus causing the band to be torn in the desired zone.

20 Claims, 3 Drawing Sheets

TEARING DEVICE FOR BANDS OF SHEET MATERIALS, SUCH AS PAPER BANDS

The present invention relates to a tearing device for band materials, such as paper bands, capable of tearing off said bands at predetermined desired zones.

More particularly the present invention relates to a tearing device by which a paper band is torn at predetermined zones, independently from the spacing between one zone and the next one, upon receiving a simple command signal derived from some characteristic or parameter bound to the band itself.

A number of tearing devices are known capable of tearing off a sheet material band, such as a paper band, at selected zones.

Said tearing devices essentially comprise at least two pairs of rollers, driven into rotation at equal speeds, the fore or downstream pair of which is accelerated to a definitely higher speed than that of the other pair when a predetermined tearing zone is positioned between the two pairs of rollers in order to cause the tearing to take place at the desired point.

For the determination of the desired point at which the tearing off is desired to occur, to date recourse has been made to the rigid synchronization of the band advancement movement with the driving motion of the motors by which the two pairs of rollers are actuated, so that for example from the counting of the number of turns of the motor driving the first roller pair the length of band passed therebetween can be calculated and consequently the point at which the tearing is desired to occur can be determined. This system makes the tearing device strictly dependent from a rigid synchronization between the band motion and the roller rotation to be obtained, for example, by means of wheels having peripheral pins engaging perforations formed along one or both edges of the band for an exact counting of the band lengths which must intervene between a tearing operation and the next one.

This solution suffers from the drawback that synchronous motors of the step-by-step type must be adopted for the two pairs of rollers, together with an electronic circuitry by which the number of turns or steps of the motor actuating the first pair of rollers is counted and a signal is emitted such as to change the rotation speed of the downstream roller pair up to cause, owing to rotation speed difference, a tearing in the predetermined zone of the band occurring between the first and second pairs of rollers, said synchronous or step-by-step motors being per se costly and requiring a complicated and expensive electronic circuitry, liable to troubles owing to disturbances and failures by which the tearing off at the correct point may be compromised.

Moreover whatever change of length of the band, namely of the interval between two tearing operations, requires a modification or different arrangement of the electronic circuitry involving the intervention of particularly skilled or qualified personnel.

The present invention eliminates the above drawbacks of structural complications and reliability problems by using at least two pairs of rollers, of which a first pair of upstream positioned perfectly cylindrical rollers is driven at constant rotation speed by a first motor and a second pair consisting of cylindrical rollers each having a planar bevel, said bevels each having a substantially equal extension, are normally maintained in a stationary condition with the two bevels facing each other, whereby the band is passed therebetween without obstacles and, upon signalling means or whatever else mark provided on the band takes a suitable position between the said two roller pairs, the second pair of rollers is actuated at a rotation speed such that their peripheral speed is definitely higher than that of the first roller pair, thus causing a tearing of the band at a purposely arranged zone, such as a weakening line, which at that time is positioned between the two said roller pairs. According to a preferred embodiment of the present invention, said signalling means consist of a discontinuance of said band positioned at a predetermined distance from the said weakening line provided in said band.

More preferably said discontinuance in the said band is a discontinuity of its optical properties.

This discontinuity of optical properties particularly consists in an opening permitting a light ray to pass through said band.

Alternatively said optical discontinuity may consist of a regularly shaped geometrical area having different reflectivity from that of the remaining band.

According to a different alternative said discontinuance consists in an area of discontinuity of the electrical properties of the band, such as an electrically conducting track marked onto the band.

According to a further alternative said discontinuance consists in a discontinuity of the magnetic properties of the band, such as a track of ferromagnetic material impressed onto the band.

More particularly, when the band discontinuance is of optical type, the detection thereof takes place by means of an assembly comprising a lighting lamp and a photoelectric detector.

If, alternatively, the discontinuance is of electrical type, the detection thereof takes place by means of an electric probe detecting the presence of the said electrically conducting track.

Furthermore, if the discontinuance is of magnetic type, the detection thereof takes place by means of a magnetic detector detecting said track of ferromagnetic material.

The features and advantages of the present invention together with further characteristics and merits thereof, shall appear more evidently from the following detailed description of an embodiment thereof, not to be construed in any manner in limiting sense, with reference to accompanying drawings in which.

Figure 1:
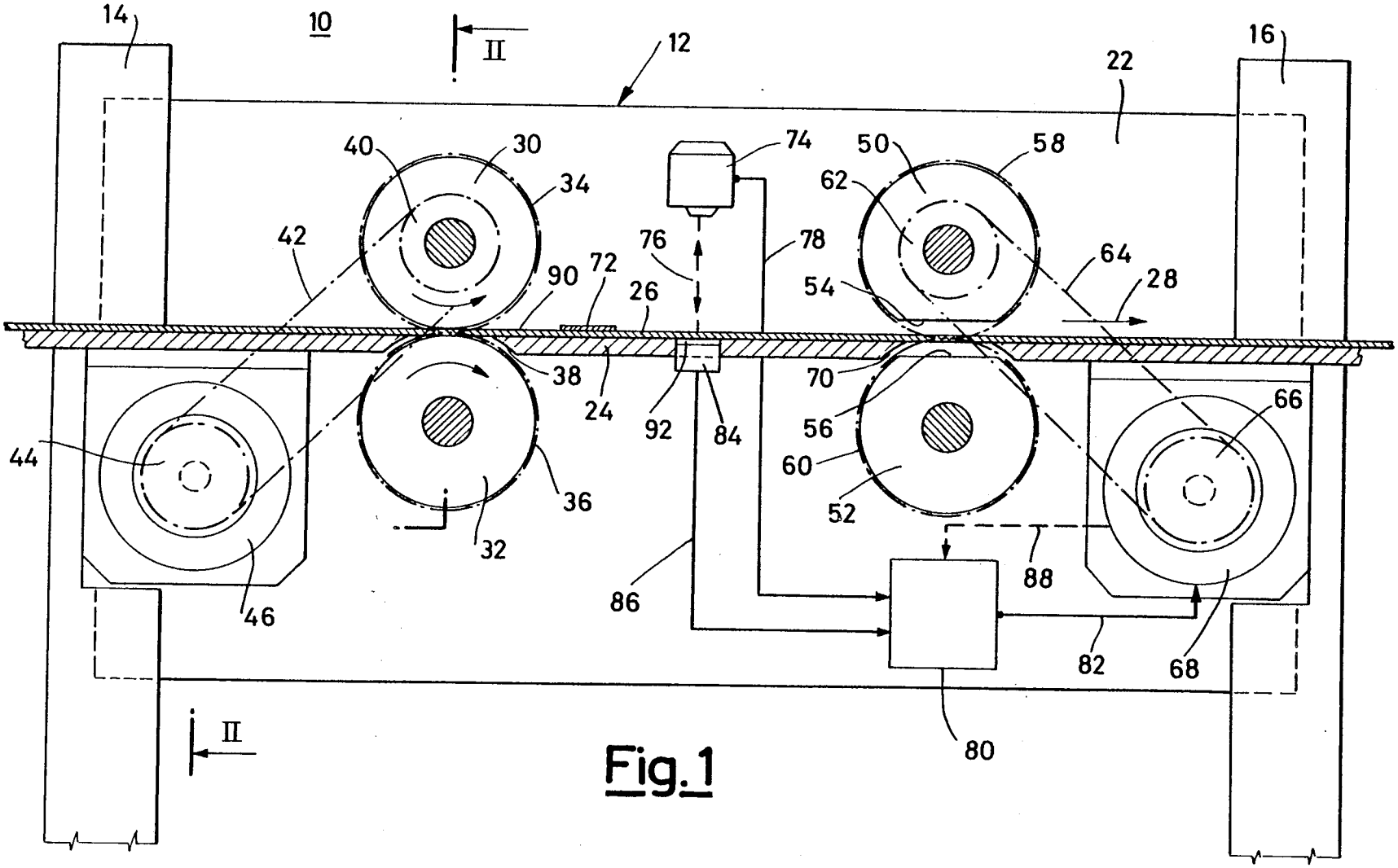
FIG. 1 is a cross-section side view, along the lines I—I of FIG. 2, of a tearing device according to the present invention.
Figure 2:
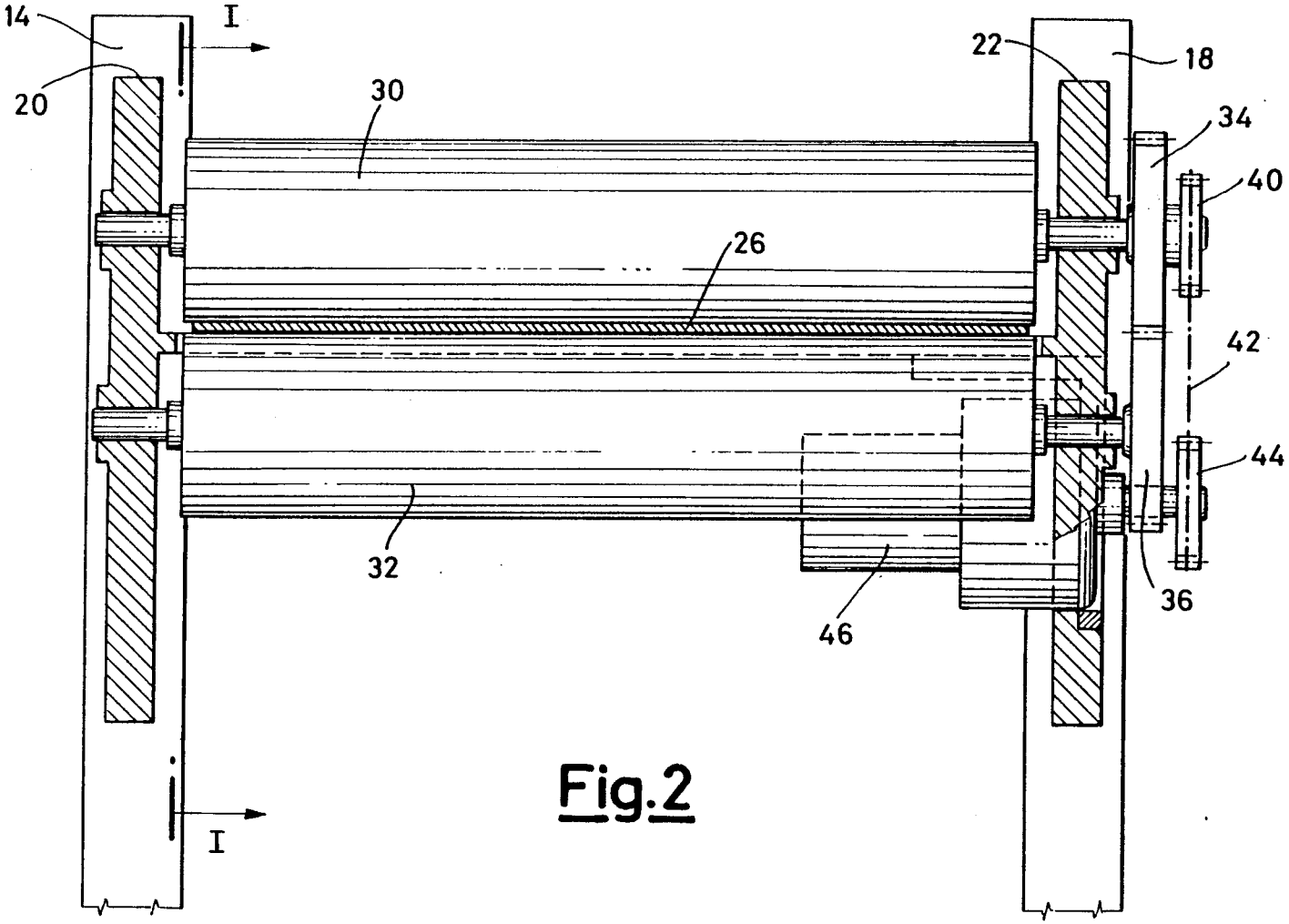
FIG. 2 is a cross-section view according to the lines II—II of FIG. 1.

Considering the FIGS. 1 and 2, the tearing device 10 according to the present invention comprises a framework 12, consisting of posts 14, 16 and 18, and cross bars or shoulders 20 and 22, connected to each other by an abutment plane 24 onto which a band 26, such as a paper band, is advanced with a sliding motion, the band having to be torn at predetermined weakening zones when the need arises of carrying out said tearing.

Said band 26 is advanced along the direction of the arrow 28 owing to the motion of a first pair of perfectly cylindrical rollers 30 and 32, having equal diameters, and connected to each other by gears 34 and 36, the lower roller 32 engaging the lower surface of said band 26 through a window 38.

The upper roller has coaxially mounted thereto a toothed wheel or like member 40 which, through a transmission member such as a chain or toothed belt, is driven from a toothed wheel 44 in turn driven by an electrical motor 46, of synchronous type, of step-by-step type or of reluctance type, by which the rollers 30 and 32 are driven at a given constant rotation speed, thus generating a more or less intense driving torque and a braking torque when said band 26 is drawn trying to cause the rollers 30 and 32 to overcome their normal rotation speed.

However it is to be observed that such a self-braking feature is not strictly necessary since for quick tearing off operations the moment of inertia alone of the rollers 30 and 32 and of the equipment connected thereto can be enough to generate a sufficient transient braking torque.

Said band 26, by prosecuting its downstream sliding motion passes through a second pair of rollers 50 and 52, each having a planar bevel 54 and 56, provided for instance by milling, and connected to each other through gears 58 and 60, the gear 58 being coupled to a coaxial wheel 62 protruding therefrom and driven, through a transmission member 64, from a wheel 66 connected to a driving assembly 68 comprising an electric motor and a clutch, which can be of whatever type provided that it is capable of driving the rollers 50 and 52 at a peripheral speed definitely higher than that of the rollers 30 and 32. A window 70 provided in the abutment plane 24 above the roller 52 permits the circumferential periphery of the same roller to get into contact with the band 26 when said roller is driven together with the roller 50.

At some intervals, close to the areas arranged for the tearing, onto the band 26 marked or signalling zones are provided which, upon coming under a detector 74, such as an assembly comprising a light emitter and a photodetector, cause it to be activated owing to the modification of a light ray 76, or the like, whereby through a connection 78 a signal is sent to a pilot or drive unit 80 (of per se known type) in order to operate, through a connection 82, said motor-clutch assembly, whereby the motion of said electric motor is transmitted to said rollers 50 and 52.

Another photodetector 84 is positioned below the abutment plane 24, at a window provided therewithin, for a function of band tearing detection to be more detailedly discussed hereinafter, this further photodetector sending its signals through a connection 86 to the same pilot unit 80. A further connection 88 from a shaft position detector to the pilot unit takes care of the detection of when the rollers 50 and 52 are returned with their planar bevels 54 and 56 facing to each other, then causing their stopping in such a position. The operation of the device of the present invention is made particularly evident from the FIGS. 3 and 4, taken together with FIG. 1.

Figure 3:
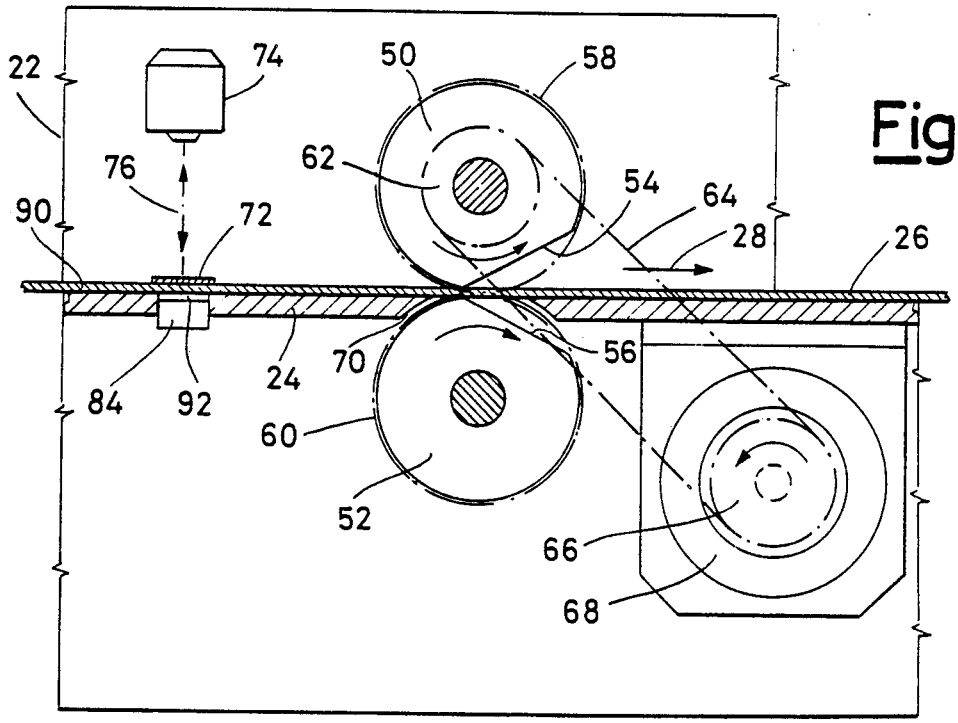
FIG. 3 is a partial view showing the pair of tearing rollers at the time of the beginning of their action.
Figure 4:
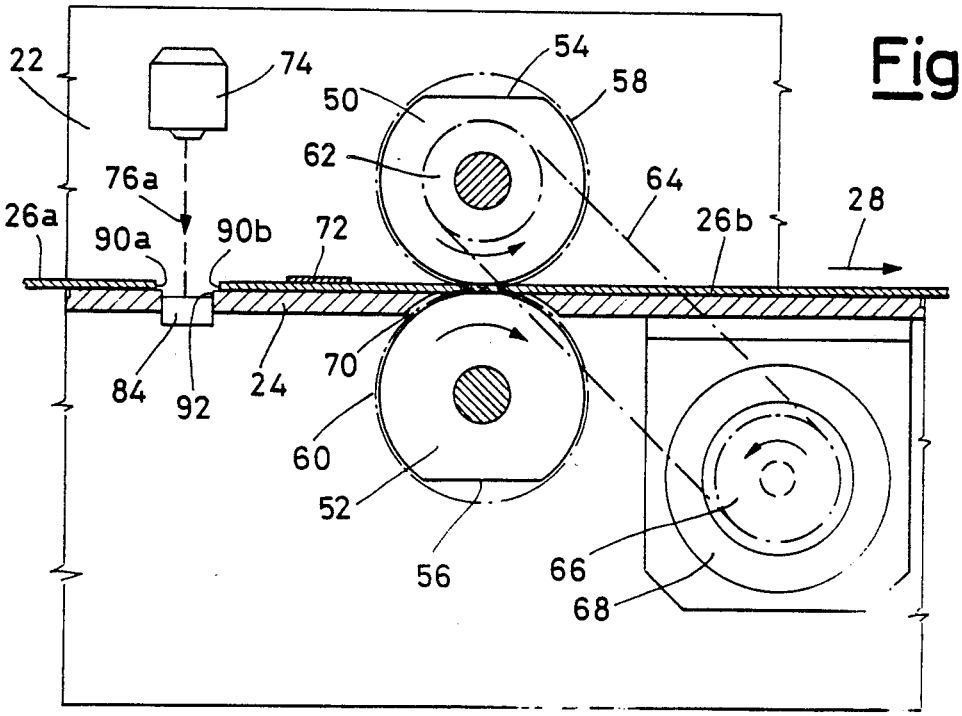
FIG. 4 is a partial view, like FIG. 3, showing the said tearing roller pair in an intermediate time of their operation.

As it is seen in the FIGS. 1 and 3, a weakening zone 90 in the band 26 is formed at a certain distance upstream of the marked zone 72, said distance being readily assessed by a person skilled in this field from the dynamic features of the assembly carrying out the tearing operation, such as the moment of inertia of the rollers 50 and 52, the rotation speed of the motor of the motor and clutch assembly 68 and the like. Normally the band 26, of white or essentially light paper, does reflect and diffuse the light ray 76 emitted from the detector 74 which comprises a photodetector receiving back said reflected light ray 76. When the marked zone 72, darker than the band 26, passes below the detector 74, the absence of reflected light is signalled causing the sending through the connection 78 of a signal to the pilot unit 80 indicating the presence of the marked zone under said detector 74. More preferably said marked zone 72 consists of alternating dark and light segments substantially perpendicularly oriented with respect to the arrow 28 of the sliding direction of the band 26 whereby a modulated reflected signal is produced which can be readily recognized with respect to the absence of reflected light as resulting from the accidental introduction of a poorly reflecting item between the detector 74 and the band 26 or from the soiling of optical parts of the detector 74 itself. The reception of the signal through the connection 78 by the pilot unit 80 causes a clutch of the motor and clutch assembly 68 to be actuated, whereby said rollers 50 and 52 are driven into rotation and, as shown in FIG. 3, start engaging the band 26 the latter being compelled to slide at a speed much higher than that allowed for by the rollers 30 and 32 which, owing to their inertia or, additionally, to the nature of their driving motor 46, do not essentially accelerate, whereby said band is subjected to a dragging tangential force which causes its tearing off in the said weakening zone 90. Once the tearing has occurred, owing to the fact that the edge **90*a* advances at a lower speed than the edge 90*b*, an interruption is originated in the band through which the light ray emitted from the detector 74 is allowed to pass as ray 76*a* towards the photodetector 84, positioned under a slit 92 formed in the said abutment plane 24. The photodetector 84, upon being hit by the light ray 76*a*, causes a signal to be sent through the connection 86 to the pilot unit 80, which is thus set for the stopping of the rollers 50 and 52, which stopping takes place when a shaft position detector (of per se known type and commercially available) causes a signal to be transmitted, through the connection 88, indicating the return of the rollers 50 and 52 in the position of FIG. 1 with the planar bevels 54 and 56 facing to each other, said stopping being provided by the opening of the clutch of the motor-clutch assembly 68 as well as by a possible braking of said rollers 50 and 52**.

Once the tearing off of the band 26 has been completed, the downstream portion **26*b* is withdrawn, whereas the upstream portion 26*a*** starts the advancing motion undergoing the downstream processing operations.

The above is the detailed description of a preferred embodiment, given for only exemplifying and non limiting purpose, and it shall be evident that to one skilled in the art equivalent solutions and embodiments shall appear, to be considered covered by the present invention.

What is claimed is:

1. A tearing device for a band comprising:

a first pair of upstream positioned cylindrical rollers each having a constant rotation speed;

a second pair of cylindrical rollers each having a planar bevel and said bevels being normally maintained in a stationary condition facing each other, said bevels having a substantially equal extension and facing each other with a spacing therebetween;

a band passing from said first pair of rollers to the facing planar bevels of said second pair of rollers, said band being provided with signaling means on one of its surfaces and a purposely arranged tearing zone; and detector means coupled with said signalling means and connected with means for imparting rotation to said second pair of rollers from the stationary condition to a rotation speed higher than the speed of said first pair of rollers;

whereby said band is under tension between said first and second pair of rollers and a breaking takes place at the tearing zone.

2. A tearing device according to claim 1, wherein said signalling means includes a discontinuity of said band, positioned at a predeterminated distance from said tearing zone.

3. A tearing device according to claim 2, wherein said signalling means is a magnetic discontinuity coupled with a magnetic detector.

4. A tearing device according to claim 3, wherein said discontinuity is a track of ferromagnetic material marked onto said band.

5. A tearing device according to claim 2, including a photoelectric detector coupled with said signalling means.

6. A tearing device according to claim 2, wherein said signalling means includes an optical discontinuity.

7. A tearing device according to claim 6, wherein said optical discontinuity is an opening and said light ray passes through said band through said opening.

8. A tearing device according to claim 6, wherein said optical discontinuity is a regularly shaped geometrical area having a reflectivity different from that of the remaining band.

9. A tearing device according to claim 1, wherein said signalling means is provided with an optical discontinuity coupled with a photoelectric detector.

10. A tearing device according to claim 9, wherein said optical discontinuity is an opening permitting a light ray to pass through said band.

11. A tearing device according to claim 9, wherein said optical discontinuity is a regularly shaped geometrical area having a reflectivity different from that of the remaining band.

12. A tearing device according to claim 1, wherein said signalling means is an electrical discontinuity coupled with an electric probe.

13. A tearing device according to claim 12, wherein said electrical discontinuity is an electrically conductive track marked on said band.

14. A tearing device according to claim 1 wherein said signalling means is a magnetic discontinuity.

15. A tearing device according to claim 14, wherein said magnetic discontinuity is a track of ferromagnetic material marked onto the band.

16. A tearing device according to claim 1, wherein said detector means is an electric probe.

17. A tearing device according to claim 1, wherein said tearing zone is positioned between said first and said second pair or rollers.

18. A tearing device according to claim 1, wherein said detector means includes a lighting lamp and a photoelectric detector.

19. A tearing device according to claim 1, wherein said signalling means includes a discontinuance of said band, said discontinuance being positioned at a predetermined distance from said weakening line.

20. A tearing device according to claim 19, wherein said discontinuance of said band comprises a track of ferromagnetic material impressed onto the band.

* * * * *